United States Patent [19]

Patriquin

[11] 4,191,037

[45] Mar. 4, 1980

[54] CYLINDER LOCK WITH KEY RESPONSIVE REMOVABLE CORE

[75] Inventor: George P. Patriquin, Gardner, Mass.

[73] Assignee: Hudson Lock, Inc., Hudson, Mass.

[21] Appl. No.: 901,445

[22] Filed: May 1, 1978

[51] Int. Cl.[2] ..... E05B 27/00

[52] U.S. Cl. ..... 70/369

[58] Field of Search ..... 70/369, 367, 368, 224

[56] References Cited

U.S. PATENT DOCUMENTS 1,986,676 1/1935 Hurd ..... 70/369

*Primary Examiner*—Robert L. Wolfe

*Attorney, Agent, or Firm*—John E. Toupal

[57] ABSTRACT

A cylinder lock with a hollow cylindrical shell that defines a plurality of shell tumblerways and is longitudinally movable in a shell cavity defined by a housing. Received by the hollow shell is a plug that defines a keyway for receiving a proper key and a plurality of plug tumblerways aligned with the shell tumblerways. The plug is rotatable within the shell but is longitudinally restrained therein. A plurality of locking tumblers are accommodated by the aligned shell and plug tumblerways and are movable from biased locked positions into open positions by a proper key in the keyway. Also responsive to a proper key is a control tumbler that can be moved out of a biased, latched position into a release position. The control tumbler obstructs longitudinal withdrawal of the shell from the shell cavity when in its latched position and permits withdrawal when in its release position.

19 Claims, 11 Drawing Figures

Fig. 4
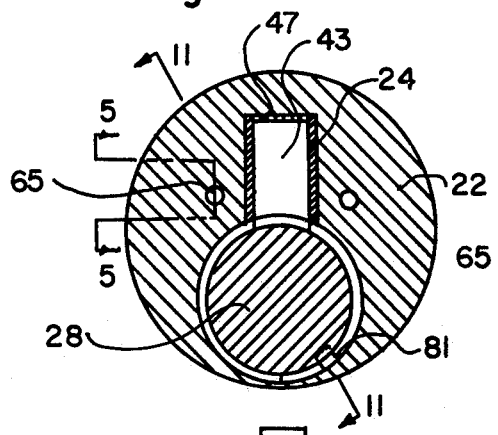
Fig. 5
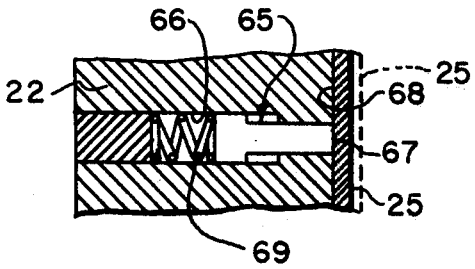
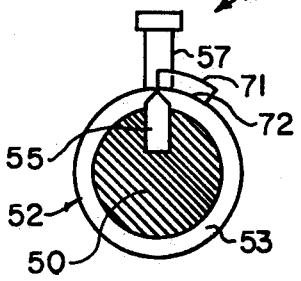
Fig. 6
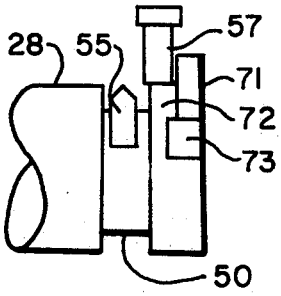
Fig. 7
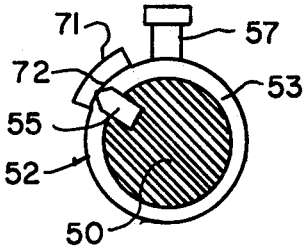
Fig. 8
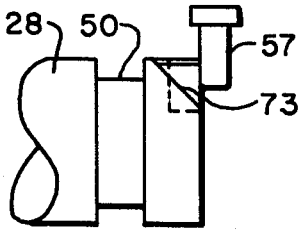
Fig. 9
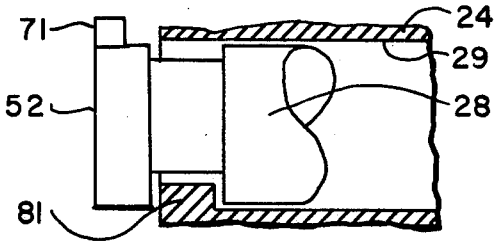
Fig. 11
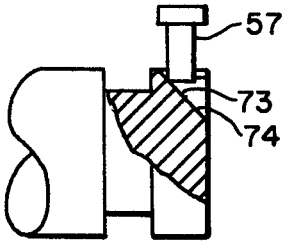
Fig. 10

CYLINDER LOCK WITH KEY RESPONSIVE REMOVABLE CORE

BACKGROUND OF THE INVENTION

This invention relates generally to locks and, more particularly, to a cylinder lock with a locking core that can be removed with a proper key.

A substantial cost of maintaining many security systems involves the required removal of locks from the structures on which they have been installed. For example, security reasons necessitate lock removal for rekeying of a lock in certain instances. The requirement for rekeying can result from either a loss of keys to the lock or the termination of an employee having had access to a key for the lock. Lock removal also can be required to effect repair of a faulty lock.

The lock removal problem is somewhat alleviated in a type of lock commerically known as a Best cylinder lock. The Best lock employs a latching mechanism that can be actuated by a proper key to permit removal of a locking core from the lock's housing. Although substantially reducing the time required for lock removal and thereby the cost of either rekeying or repair, the Best locks exhibit the disadvantages of relatively high cost and a size that is excessive for many applications.

The object of this invention, therefore, is to provide a comparatively small, low cost lock with reasonable security and a locking core that can be easily removed with a proper key.

SUMMARY OF THE INVENTION

The invention is a cylinder lock with a hollow cylindrical shell that defines a plurality of shell tumblerways and is longitudinally movable in a shell cavity defined by a housing. Received by the hollow shell is a plug that defines a keyway for receiving a proper key and a plurality of plug tumblerways aligned with the shell tumblerways. The plug is rotatable within the shell but is longitudinally restrained therein. A plurality of locking tumblers are accommodated by the aligned shell and plug tumblerways and are movable from biased locked positions into open positions by a proper key in the keyway. Also responsive to a proper key is a control tumbler that can be moved out of a biased, latched position into a release position. The control tumbler obstructs longitudinal withdrawal of the shell from the shell cavity when in its latched position and permits withdrawal when in its release position. In response to appropriate manipulation of a proper key in the keyway, the control tumbler is actuated to permit longitudinal removal of the composite plug and shell core from the lock's housing so as to facilitate either rekeying or repair thereof.

In a featured embodiment, the control tumbler comprises a control pin retained by a control pinway in the housing and a driver pin retained by a driver pinway in the plug. Located between the control and driver pinways and defined by the plug is a groove extending transverse to the axis of the lock. When in its latched position, the control pin extends into the groove which prevents longitudinal movement of the plug while accommodating rotational movement thereof. Insertion of a proper key into the keyway elevates the driver pin to force the control pin into a release position out of the groove and thereby eliminates the obstruction to longitudinal movement of the plug.

According to one feature of the invention, a blocking flange secured to and rotatable with the plug is disposed so as to engage the control pin and prevent withdrawal of the locking core with the plug in its locked position even though the control pin has been moved into its release position. However, after a given degree of plug rotation, the blocking flange clears the control pin so as to permit withdrawal of the locking core. The requirement for plug rotation prior to withdrawal of the locking core eliminates the possibility that the lock's security can be violated by removal of the core after merely picking the control pin with the plug in its locked position.

DESCRIPTION OF THE DRAWINGS

These and other features of the invention will become more apparent upon a perusal of the following description taken in conjunction with the accompanying drawings wherein:

FIG. 4 is a cross-sectional view of the lock shown in FIG. 3 taken along lines 4—4;

FIG. 5 is a cross-sectional view of the lock shown in FIG. 4 taken along lines 5—5;

FIG. 6 is a fragmentary cross-sectional view of the lock taken along the lines 6—6 of FIG. 3 and depicting particular elements of the lock in given operating positions;

FIG. 7 is a side view of the illustration shown in FIG. 6;

FIG. 8 is a cross-sectional view similar to that shown in FIG. 6 with the elements in different operating positions;

FIG. 9 is a side view of the illustration shown in FIG. 8;

FIG. 10 is a side view similar to the views of FIGS. 7 and 9 with the elements in different operating positions; and FIG. 11 is a fragmentary cross-sectional view taken along lines 11—11 of FIG. 4.

DESCRIPTION OF THE PREFERRED EMBODIMENT

Figure 1:
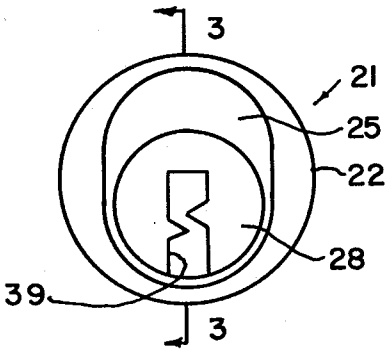
FIG. 1 is a schematic front view of a cylinder lock according to the invention.
Figure 2:
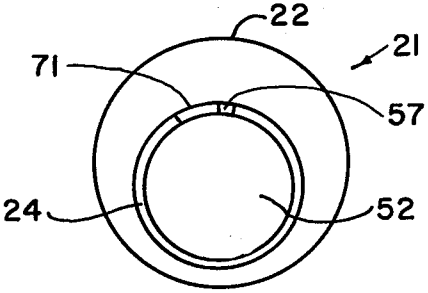
FIG. 2 is a rear view of the lock shown in FIG. 1.

Referring now to FIGS. 1–4, there is shown a cylinder lock 21 constructed according to the present invention. A cylindrical housing 22 defines a shell cavity 23 that conforms to and receives a shell 24. Composing the shell 24 is an oblong face 25 on a body that is formed by a portion 26 of rectangular cross section and a hollow cylindrical portion 27 extending therefrom. A cylindrical plug 28 is received by a plug cavity 29 defined by the shell 24 and forms therewith a composite core assembly 31.

Formed in the rectangular portion 26 of the shell 24 are a plurality of pinways or tumblerways 32 each of which accommodates a locking pin tumbler 33. Similarly formed in the plug 28 are a plurality of plug tumblerways or pinways 35, one aligned with each of the shell pinways 32 and retaining a locking driver pin 36. The locking tumblers 33 are normally biased by springs 38 into locked positions partially within the plug pinways 35 so as to prevent rotational movement of the plug 28 within the plug cavity 29. However, in response to the insertion of a proper key into a keyway 39 extending through the plug 28, the locking driver pins 36 are actuated in the conventional manner to force the locking pins 33 into open or shear positions that permit rotation of the plug 28 within the plug cavity 29.

Also formed in the rectangular portion 26 of the shell 24 is a slot 41 having an internal shoulder 42. Received by the slot 41 is a retainer 43 that rests upon the shoulder 42 and has a lower arcuate periphery 44 that extends into a circumferential recess 45 in the plug 28. The retainer 43 couples together the shell 24 and the plug 28 so as to prevent relative longitudinal motion therebetween while permitting rotational movement of the plug 28 within the plug cavity 29. Covering the pinways 32 and the slot 41 is a shell cover 47 that retains the springs 38 and the retainer 43.

Figure 3:
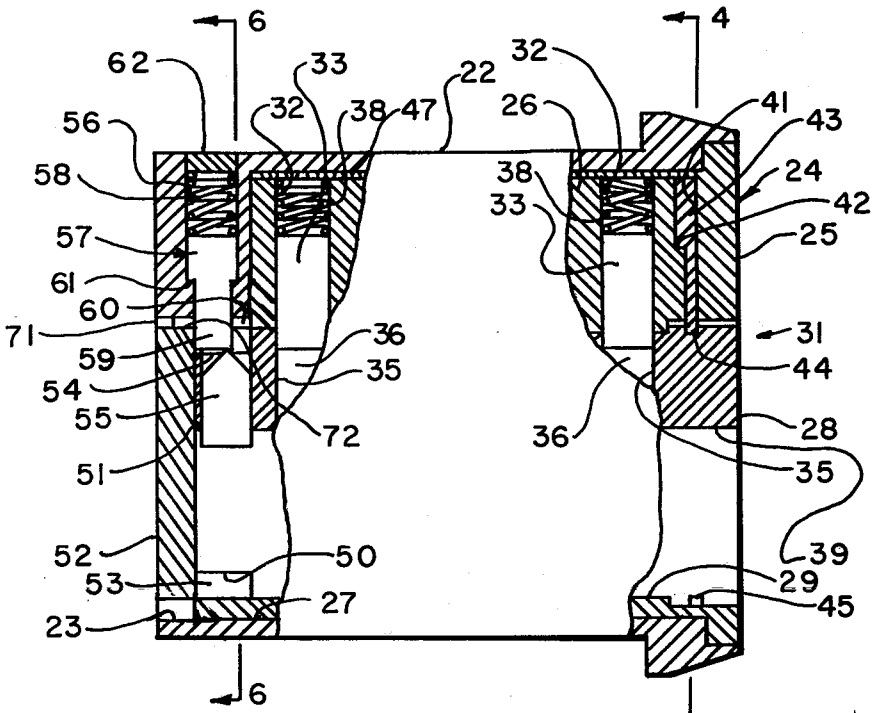
FIG. 3 is a partial cross-sectional view of the lock shown in FIG. 1 taken along the lines 3—3.

As shown most clearly in FIG. 3, the plug 28 terminates inwardly with a cylindrical portion 51 of reduced diameter. Fixed to the reduced plug portion 51 so as to be rotatable with the plug 28 is a circular control plate 52. The control plate 52 has the same diameter as the main body of the plug 28 so as to form therebetween an annular groove 53 having a bottom surface 50 defined by the reduced diameter plug portion 51. Formed in the plug portion 51 is a driver tumblerway 54 retaining a driver pin 55 that extends into the keyway 39. A control tumblerway 56 formed in the housing 22 is aligned with the driver tumblerway 54 and separated therefrom by the annular groove 53. Received by the control tumblerway 56 is a control pin tumbler 57 that is biased by a spring member 58 into a latched position as shown in FIG. 3. In that position, an inner portion 59 of the control pin 57 extends through a slot 60 in the shell 24 into the annular groove 53 and a shoulder portion 61 is supported by a shoulder formed in the control tumblerway 56. A retainer 62 closes the opening to the control tumblerway 56 so as to retain therein the control pin 57 and the spring member 58. When in the latched positions illustrated in FIG. 3, the annular groove 53 and received control pin 57 longitudinally couple together the plug 28 and the housing 22 so as to prevent withdrawal movement therefrom of the composite locking core assembly 31.

Referring now to FIGS. 4 and 5, there are shown two ejection pins 65 (only one of which is shown in FIG. 5) that extend parallel to the axis of the lock 21 and are located on opposite sides of the rectangular portion 26 of the shell 24. The ejection pins 65 are retained within bores 66 in the housing 22 and have ends 67 biased against the inner surface 68 of the shell's face 25 by spring members 69. As described below, the ejection pins 65 exert a force against the face 25 that is effective under certain conditions to partially eject the shell 24 from the shell cavity 23 into the position shown by dotted lines in FIG. 5.

As shown most clearly in FIGS. 3 and 6, a blocking flange 71 extends radially from the control plate 52. The flange 71 has a diameter approximately equal to the diameter of the shell's cylindrical portion 27 and has a width less than the width of the control plate 52 so as to establish on the periphery thereof a support surface 72 extending between the flange 71 and the annular groove 53. As described more fully below, the support surface 72 during one phase of core removal supports the control pin 57 which in turn engages the blocking flange 71 to limit withdrawal movement of the core assembly 31 to the position shown by dotted lines in FIG. 5.

During typical use, the lock 21 would be installed in the door (not shown) of an enclosure such as a locker, mailbox, cabinet, etc. Locking and unlocking action of the lock 21 would be controlled in the conventional manner by the insertion of a proper key into the keyway 39. Such a key would be cut so as to force the driver pins 36 and thereby the locking pins 33 out of the locked positions shown in FIG. 3 into open or shear positions that permit rotation of the plug 28 within the plug cavity 29. The resultant rotation of the control plate 52 would effect actuation of a bolt assembly (not shown) to control access to the enclosure (not shown) in which the lock 21 is installed.

The above-described lock operation is conventional for cylinder locks. However, the present lock is distinguished from prior cylinder locks in that a proper key can be inserted into the keyway 39 and used to actuate the control tumbler 57 and thereby permit removal of the core assembly 31 from the housing 22. The removal can be quickly and easily accomplished at any time that either rekeying or repair of the lock 21 is required. It will be understood that the lock 21 would normally accommodate more than one key, not all of which would possess the same operational capability. For example, a regular key would be cut to produce movement of the locking tumblers 33 into open positions but would not effect control movement of the control pin 57 so as to permit removal of the core assembly 31. Thus, a regular key could be used to gain access to an enclosure in which the lock 21 is installed but could not be used to effect removal of the core assembly 31 from the housing 22. A regular key would be used typically by one requiring regular access to the particular enclosure in which the lock 21 is installed. Conversely, a control key would be cut to produce both movement of the locking pins 33 into open positions and movement of the control pin 57 into a release position that permits removal of the core assembly 31. Generally, possession of a control key would be limited to a custodian or security officer having the responsibility for repair or rekeying of the locks installed on all of the enclosures encompassed within a given security system.

The manner in which the locking core assembly 31 is removed from the housing 22 will be described in connection with FIGS. 6–10 which are fragmentary views showing certain components of the lock 21 in various operational positions. Insertion of a control key into the keyway 39 forces the driver pin 55 and the control pin 57 out of the latched positions shown in FIG. 3 into the release positions shown in FIGS. 6 and 7. In its release position, the lower end of the control pin 57 is at the shear level established by the circumference of the control plate 52 and out of the annular groove 53. After elimination of engagement between the control pin 57 and the side walls of the annular groove 53, the ejection pins 65 exert a force on the shell's face 25 that moves the shell 24 partially out of the housing 22 into the position shown by dotted lines in FIG. 5. Further longitudinal withdrawal movement of the core assembly 31 is prevented, however, by engagement between the control pin 57 and the blocking flange 71 as illustrated in FIG. 7. In that position, the driver pin 55 no longer engages the control pin 57 which is now supported on the support surface 72. Thus, complete removal of the core 31 cannot be effected by a picking operation that merely draws the control pin into its release position. However, with a control key in the keyway 39 the locking pins 33 are forced into their open positions and the plug 28 can be rotated into a withdrawal position as illustrated in FIG. 8. With the plug 28 and the attached control plate 52 in the withdrawal position, the blocking flange 71 is out of longitudinal alignment with the control pin 57. Thus, all restrictions to longitudinal movement are eliminated and the locking core 31 can be completely removed as a unit from the housing 22.

It will be noted that during removal of the core 31 and, as shown in FIG. 9, the control pin 57 drops down into its biased latched position after removal of the support previously provided by the control plate surface 72. Thus, upon reinsertion of the core 31, the control pin 57 must be elevated into its release position so as to clear and allow reinsertion of the control plate 52. This elevation of the control pin 57 is provided by a recess 73 in the peripheral surface of the control plate 52. The recess 73 is located directly adjacent to one end of the blocking flange 71 and has a bottom defined by an inclined camming surface 74. When a control key retaining core assembly 71 is oriented into the withdrawal position shown in FIG. 8 and inserted into the housing 22, the camming surface 74 engages the control pin 57 which is thereby forced upwardly onto the support surface 72. The core assembly 31 can then be rotated clockwise as shown in FIG. 8 back into the locked position shown in FIG. 6. Upon reaching that position and after removal of the control key, an inward push on the shell's face 25 causes the control pin 57 to fall into the annular groove 53 thereby again securing the core assembly 31 within the housing 22.

To facilitate either removal or replacement of the locking core unit 31, a positioning stop 81 is provided as illustrated in FIG. 11 and by dotted lines in FIG. 4. The stop 81 comprises a lug formed in the plug cavity 29 and extending into the slot 53. During operation of the lock 21 with a regular key, the stop 81 serves no function and is accommodated by the slot 53 during 360-degree rotation of the plug 28. However, a control key (not shown) would possess a heel portion that engages the stop 81 after rotation of the plug 28 into the withdrawal position shown in FIG. 8. Thus, the positioning stop 81 assists a key operator in properly orienting the plug 28 within the shell 24 during removal and replacement operations. This feature is particularly desirable during a replacement operation so as to insure alignment between the control pin 57 and the camming surface 74 for the reasons described above.

It will be noted, however, that during full rotation of the plug 28 by a regular key, the driver pin 55 will be forced by gravity out of the driver pinway 54 into the slot 53. Thus, after having entered the slot 53, the driver pin 55 will come into contact with the positioning stop 81 during rotation of the plug 28 within the plug cavity 29. To prevent this engagement from obstructing plug rotation beyond the withdrawal position illustrated in FIG. 8, the outer periphery of the driver pin 55 is provided with a conical surface. Thus, upon engaging the positioning stop 81 the driver 55 is cammed thereby back into the pinway 54 allowing continued rotation of the plug 28.

Obviously, many modifications and variations of the present invention are possible in light of the above teachings. It is to be understood, therefore, that the invention can be practiced otherwise than as specifically described.

What is claimed is:

1. A cylinder lock comprising:

a housing defining a shell cavity;

a shell received by and longitudinally movable in said shell cavity and defining a plug cavity, said shell further defining a plurality of shell tumblerways;

a plug received by and rotatable in said plug cavity and defining a plurality of plug tumblerways aligned with said shell tumblerways, said plug further defining a keyway for receiving a proper key;

a plurality of locking tumbler means positioned in said aligned shell and plug tumblerways, said tumbler means being biased into locked positions and movable into open positions by a proper key in said keyway, said tumbler means preventing rotation of said plug in said plug cavity when in said locked positions and permitting rotation thereof when in said open positions;

a control tumbler means biased into a latched position and forced into a release position by a proper key in said keyway, said control tumbler means disposed so as to obstruct longitudinal withdrawal of said shell from said shell cavity when in said latched position and to permit said movement thereof when in said release position; and means for preventing longitudinal movement of said plug in said plug cavity and permitting rotational movement thereof.

2. A cylinder lock according to claim 1 wherein said control tumbler means comprises a control tumbler and a driver, said housing defines a control tumblerway retaining said control tumbler, said plug defines a driver tumblerway retaining said driver and aligned with said control tumblerway, said driver being operable by a proper key in said keyway to force said control tumbler into said release position.

3. A cylinder lock according to claim 2 comprising coupling means operable with said control tumbler means in said latched position to longitudinally couple together said housing and said plug so as to prevent relative longitudinal movement therebetween.

4. A cylinder lock according to claim 3 wherein said coupling means comprises a groove defined by said plug and extending transverse to the axis of said lock, said groove engaging said control tumbler when in said latched position so as to prevent longitudinal movement of said plug and accommodating said control tumbler during rotational movement of said plug, and wherein said control tumbler is forced out of said groove into said release position by a proper key in said keyway.

5. A cylinder lock according to claim 4 wherein said groove is located between said control and driver tumblerways.

6. A cylinder lock according to claim 2 wherein said plug is rotatable in said plug cavity between a locked position and a withdrawal position, and including blocking means for preventing longitudinal movement of said plug when in said locked position and allowing said movement thereof when in said withdrawal position.

7. A cylinder lock according to claim 6 wherein said blocking means comprises a flange secured to and rotatable with said plug and disposed so as to engage said control tumbler and prevent longitudinal withdrawal movement of said shell with said control tumbler in said release position and said plug in said locked position and to permit longitudinal withdrawal movement of said shell with said control tumbler in said release position and said plug in said withdrawal position.

8. A cylinder lock according to claim 7 including retainer means for retaining said control tumbler in said release position during rotation of said plug from said locked position to said withdrawal position.

9. A cylinder lock according to claim 8 wherein said retainer means comprises a support surface on said plug for supporting said control tumbler after withdrawal from said groove.

10. A cylinder lock according to claim 9 wherein said support surface extends between an upper edge of said groove and said flange.

11. A cylinder lock according to claim 10 wherein said retainer means further comprises ejection means for producing longitudinal movement of said plug so as to move said support surface under said control tumbler after withdrawal thereof from said groove.

12. A cylinder lock according to claim 11 including insertion means for automatically moving said control tumbler into said release position in response to inward movement of said plug and said shell into said shell cavity with said plug in said withdrawal position.

13. A cylinder lock according to claim 12 wherein said insertion means comprises a cam surface defined by said plug and disposed to cam said control tumbler onto said support surface in response to said inward movement of said plug.

14. A cylinder lock according to claim 11 wherein said ejection means comprises spring bias means coupled between said housing and said shell and exerting a force tending to produce longitudinal separation thereof.

15. A cylinder lock according to claim 14 including insertion means for automatically moving said control tumbler into said release position in response to inward movement of said plug and said shell into said shell cavity with said plug in said withdrawal position.

16. A cylinder lock according to claim 15 wherein said insertion means comprises a cam surface defined by said plug and disposed to cam said control tumbler onto said support surface in response to said inward movement of said plug.

17. A cylinder lock according to claim 6 including a stop means positioned to engage a proper key in said keyway upon rotation of said plug into said withdrawal position.

18. A cylinder lock according to claim 17 wherein said stop means comprises a lug formed in said shell plug cavity and extending into said groove.

19. A cylinder lock according to claim 18 wherein said driver comprises a conical periphery for engaging said lug during rotation of said plug.

* * * * *